United States Patent [19]

Slama

[11] 4,319,870

[45] Mar. 16, 1982

[54] APPARATUS FOR THE MANUFACTURE OF FIBROUS WEBS

[75] Inventor: Frank M. Slama, Appleton, Wis.

[73] Assignee: American Can Company, Greenwich, Conn.

[21] Appl. No.: 70,001

[22] Filed: Aug. 27, 1979

[51] Int. Cl.[3] ..... B29D 7/00

[52] U.S. Cl. ..... 425/83.1

[58] Field of Search ..... 425/83.1, 81.1

[56] References Cited

U.S. PATENT DOCUMENTS 3,765,971 10/1973 Fleissner ..... 425/81

3,825,381 7/1974 Dunning et al. ..... 425/81.1

*Primary Examiner*—James R. Hall

*Attorney, Agent, or Firm*—Robert P. Auber; George P. Ziehmer; Harry W. Hargis, III

[57] ABSTRACT

Apparatus for manufacture of fibrous webs including means to spray adhesive binder particles onto a fibrous web supported on a forming wire includes spray heads in a spray booth through which the wire passes, and a pair of baffles extending transversely of the plane of the web, at opposite sides thereof. The baffles and portions of the booth are relatively closely spaced from the web, to form elongate openings below the plane of the web. A suction box having an opening beneath the web and forming wire draws air through the web and wire in a pair of flow paths that lead upwardly through the elongate openings between the baffles and the web, then downwardly through the web and the wire. The air drawn upwardly between the baffles and the web prevents sprayed-on particles of binder material near sides of the web from escaping and contaminating adjacent portions of the apparatus.

6 Claims, 2 Drawing Figures

APPARATUS FOR THE MANUFACTURE OF FIBROUS WEBS

BACKROUND OF THE INVENTION

This invention relates to the manufacture of fibrous webs, and especially to apparatus useful in the manufacture of paper from dry laid fibers.

In the manufacture of fibrous webs such as paper, using dry laying techniques, it has been found advantageous to spray particles of binder material onto a dry web to enhance its strength for subsequent operations. A disadvantage of such spraying is the tendency of binder particles to escape the edges of the web, resulting in both waste of binder and contamination of adjacent portions of the apparatus. A solution to this problem has been the provision of means for applying electrostatic charges in such a manner as to ensure impingement of particles on a web. Provision of such means and its operation are, however, costly.

The following U.S. patents are representative of prior art believed material to the examination of this application:

U.S. Pat. No. 3,536,580 dicloses apparatus for spraying electrostatically charged particles of sizing material onto an oppositely charged fibrous web in a paper making machine.

U.S. Pat. No. 3,765,971 discloses apparatus for producing a fibrous web in combination with means for distributing bonding material over the web.

U.S. Pat. No. 3, 930,614 discloses apparatus for spraying a traveling web of paper with electrostatically charged liquid.

U.S. Pat. No. 3,825,381 discloses (FIG. 10) oppositely disposed baffles 182 that intercept spray droplets of water sprayed onto a web and direct such water into troughs 184 for disposal.

It is a general objective of the present invention to provide improved apparatus for manufacturing air laid fibrous webs.

It is a further and more specific objective of the invention to provide improved means for directing particulate components onto fibrous webs in the course of its manufacture.

SUMMARY OF THE INVENTION

In achievement of the foregoing as well as other objectives and advantages, the invention contemplates, in apparatus for forming a fibrous web on a forming wire, the combination of suction box means including an opening disposed to one side of said forming wire to draw air therethrough, means for spraying particulate matter on the side of the web on said forming wire opposite the opening of said suction box means, and baffle means disposed in closely spaced relation to opposite edge portions of said forming wire and said suction box means and cooperative therewith to effect flow of ambient air upwardly over the edges portions of said forming wire and web and through the latter into the opening of said suction box, whereby to ensure full impingement of said particulate matter on said fibrous web.

The manner in which the foregoing at well as other objectives and advantages may best be achieved will be more fully understood from a consideration of the following description, taken in light of the accompanying drawing.

DESCRIPTION OF THE PREFERRED EMBODIMENT

Figure 1:
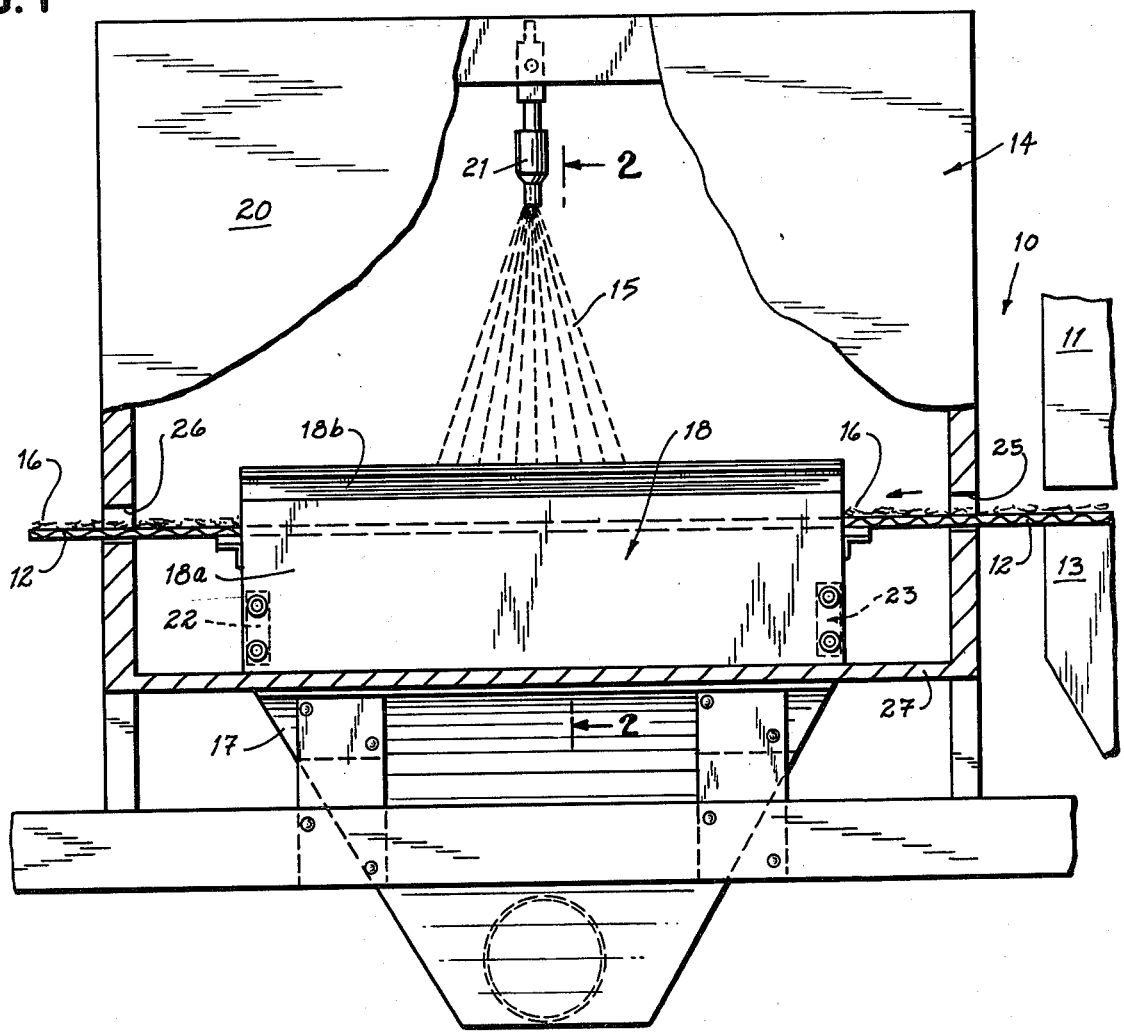
FIG. 1 is a side elevational showing of apparatus embodying the invention, with parts broken away for convenience of illustration.

With more detailed reference to the drawing, there is seen in FIG. 1 a fibrous web forming apparatus 10 comprising a set of dry fiber distributors designated generally by the numeral 11 disposed above a forming wire 12 supported for linear movement above suction boxes designated generally by the numeral 13. Construction and arrangement is such that fibers are laid on forming wire 12, with the aid of suction boxes 13, to form a fibrous web 16. Disposed downstream of the distributors 11 is a spray apparatus 14 including spraying means comprising an array of downwardly directed spray heads 21 operative to direct particles of binder material 15 onto the upper surface of web 16 on forming wire 12, aided by a suction box 17 having its opening disposed beneath wire 12 and opposite spray apparatus 14. Spray apparatus 14 further includes a booth 20 substantially enclosing the array of spray heads 21, and the portion of forming wire 12 and web 16 thereon extending over the suction box opening. Movement of wire 12 and web 16 through booth 20 is accommodated by slots 25 and 26.

Figure 2:
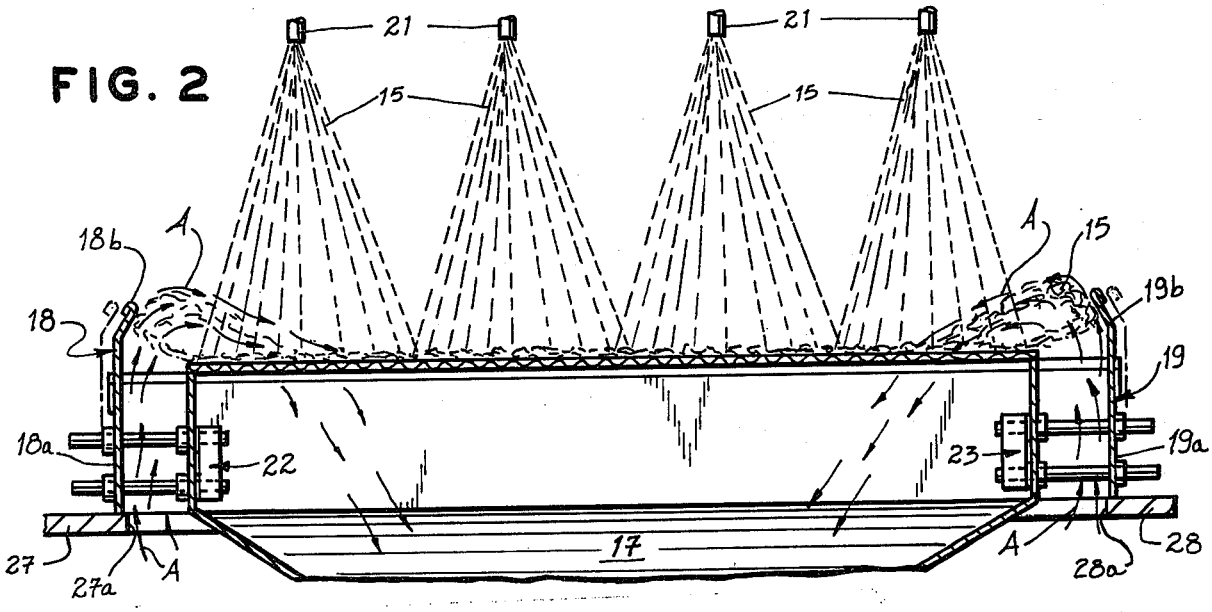
FIG. 2 is a sectional view taken generally in the plane of line 2—2 in FIG. 1, and looking in the direction of arrows applied thereto.

In especial accordance with the invention, and with reference also to FIG. 2, a pair of elongate baffles means or 18 and 19 are disposed to extend along opposite edge portions or of forming wire 12, in closely spaced relationship thereto and to adjacent sides of the suction box, and in the region of spray apparatus 14. As is seen to advantage in FIG. 2, each of baffles 18 and 19 includes a vertical section **18*a* and 19*a*, respectively, major portions of which confront the sides of the suction box, and an angular section 18*b* and 19*b*, respectively, each inclined toward the other in regions between spray heads 21 and the surfaces of forming wire 12 and web 16. The baffles 18 and 19 conveniently are mounted on brackets 22 and 23, respectively, that are so constructed and arranged as to provide for selective adjustments of the baffles (see broken line showings 18, and 19) toward and away from forming wire 12** to allow for variations in the widths of forming wires and fibrous webs being formed thereon.

As is seen also in FIG. 2, and in further accordance with the invention, lower walls 27 and 28 of booth 20 are spaced from sides of suction box 17 at **27*a* and 28*a* to form elongate openings corresponding substantially to the spacing of baffles 18, 19 from the same sides of the suction box and the edges of forming wire 12. Also, the lower ends of baffle sections 18*a*, 19*a* conveniently slidingly engage the lower walls 27, 28, respectively, in accomodation of adjustment of the baffles while effectively forming an air seal ensuring air flow upwardly between the baffles and confronting portions of the suction box and edges of the forming wire, as is shown by air-flow arrows A in FIG. 2. Advantageously, particles of binder material that normally would overshoot edges of the forming wire are entrained in this suction-box-induced, upwardly directed flow of ambient air A between the baffles and the forming wire, whereupon the same particles advantageously are subjected to subsequent inwardly directed flow effected by the angular baffle sections 18***b*, 19*b*, followed by downwardly directed, suction-box-induced flow of the same air onto the web.

While the invention has been described with reference to a preferred embodiment, it will be apparent to those skilled in the art that various changes and modifications can be made without departing from the scope of the appended claims.

I claim:

1. In an apparatus for the m anufacture of fibrous webs, comprising a linearly movable forming wire, means for directing a dispersion of dry fibers in air onto one side of said forming wire in formation of a dry-laid fibrous web thereon, a suction box having an opening over which there extends a side of said forming wire opposite said one side and operative to draw said dispersion onto said forming wire for passage of air therethrough and deposit of fibers thereon to form said web, said forming wire and said suction box opening having substantially mutually aligned, opposite edge portions extending in the direction of movement of said forming wire, and means for spraying binder material onto said web as it is moved over the opening of said suction box, the improvement comprising:

a pair of baffle means, each in confronting, closely spaced relationship to one of said mutually aligned opposite said edge portions of said forming wire and said suction box opening, said baffle means and said edge portions being so cooperatively disposed as to define paths for suction box-induced, upwardly directed flows of ambient air therebetween and onto said web to entrain binder material in the region of said edge portions and to direct said material onto said web.

2. The apparatus of claim 1, wherein said spraying means further includes a booth through which said forming wire and web thereon are movable, said booth and said baffle means being cooperatively disposed to ensure that substantially all air flow onto said web is introduced between said baffle means and said edge portions of said forming wire and said web thereon.

3. The apparatus of claim 1 or 2, wherein each of said baffle means is an elongate member extending along said edge portion of said forming wire.

4. The apparatus of claim 3, wherein each of said elongate members, in cross section, includes a straight section and an angular section inclined toward the like section of the other baffle means in regions between the surface of said forming wire and said spraying means.

5. The apparatus of claim 3, wherein each of said baffle means is mounted for selective adjustable movements toward and away from said edge portions of said forming wire.

6. The apparatus of claim 4, wherein each of said baffle means is mounted for selective adjustable movements toward and away from said edge portions of said forming wire.

* * * * *